US005150572A

United States Patent [19]

Johnson et al.

[11] Patent Number: 5,150,572

[45] Date of Patent: Sep. 29, 1992

[54] INSULATED EXHAUST PORT LINER

[75] Inventors: Kenneth L. Johnson, Cincinnatti, Ohio; William A. Updike, St. Louis, Mo.

[73] Assignee: Cummins Engine Company, Inc., Columbus, Ind.

[21] Appl. No.: 659,037

[22] Filed: Feb. 21, 1991

[51] Int. Cl.[5] ..... F01N 07/14

[52] U.S. Cl. ..... 60/272; 60/282; 60/323; 123/193.5

[58] Field of Search ..... 60/272, 282, 323; 123/193 H

[56] References Cited

U.S. PATENT DOCUMENTS

| | | | |
|---|---|---|---|
| 3,984,977 | 10/1976 | Morita et al. | 60/272 |
| 4,031,699 | 6/1977 | Suga et al. | 60/282 |
| 4,037,408 | 7/1977 | Ozawa | 60/282 |
| 4,103,487 | 8/1978 | Yamazaki et al. | 60/282 |
| 4,195,477 | 4/1980 | Yamazaki et al. | 60/282 |
| 4,195,478 | 4/1980 | Rao et al. | 60/282 |
| 4,206,598 | 6/1980 | Rao et al. | 60/282 |
| 4,207,660 | 6/1980 | Rao et al. | 29/156.4 |
| 4,346,556 | 8/1982 | Rice et al. | 60/272 |
| 4,430,856 | 2/1984 | Niedert | 60/272 |
| 4,604,779 | 8/1986 | Narita et al. | 60/272 |
| 4,676,064 | 6/1987 | Narita et al. | 60/272 |

FOREIGN PATENT DOCUMENTS

| | | | |
|---|---|---|---|
| 521317 | 1/1977 | Japan | 60/272 |

*Primary Examiner*—Ira S. Lazarus
*Assistant Examiner*—L. Heyman
*Attorney, Agent, or Firm*—Woodard, Emhardt, Naughton Moriarty & McNett

[57] ABSTRACT

An exhaust port liner assembly for use in a cylinder head of a vehicle engine composed of spaced inner and outer tubular metal shells having a mass of heat insulating material within the spaced shells and a gasket within the said spaced shells adjacent the outlet port. A metal cylinder head is cast around the spaced inner and outer shells while a removable insert is positioned within the spaced shells adjacent the outlet port. After casting of the metal cylinder head, the insert is removed and replaced by a gasket member.

4 Claims, 3 Drawing Sheets

INSULATED EXHAUST PORT LINER

The present invention relates to a method of producing a cylinder head for an internal combustion engine and to the production of a novel insulated exhaust port liner therefor.

BACKGROUND OF THE INVENTION

It is now common practice to purify gases exhausting from an internal combustion engine and for purification it is desired that the temperature of the exhaust gases be maintained high so as to most efficiently accomplish removal of noxious components. Insulated exhaust gas port liners are employed to achieve this desideratum.

OBJECTS OF THE INVENTION

It is therefore a principal object of this invention to provide a novel exhaust port liner for use in cylinder heads of internal combustion engines, which liners exhibit many advantages over known prior art liners.

Another object of the invention is to provide an improved insulated exhaust port liner assembly which is substantially unaffected by shrinkage during casting of the cylinder head.

A further object of the invention is to provide an improved exhaust port liner assembly having compliant insulation which avoids brittle fracture when subjected to temperature changes unlike monolithic ceramic port liners.

It is also an object of the invention to provide an improved exhaust port liner assembly which insulates the cylinder head from exhaust heat flux and permits expansion of the port liner while reducing thermal cycling fatigue of the cylinder head casting and the exhaust port liner.

It is also an object of the invention to provide a method for producing the improved exhaust port liner.

Another object of this invention is to provide a method of producing a cylinder head having therein an exhaust port and a novel and advantageous liner for the exhaust port.

It is another object of this invention to provide a method of producing a cylinder head having therein an exhaust port which eliminates the use of a port shaped sand core for casting of the cylinder head.

SUMMARY OF THE INVENTION

The present invention provides an exhaust port liner assembly for a cylinder head having at least one exhaust port and at least one exhaust valve seat comprising a tubular exhaust port liner composed of spaced inner and outer tubular metal shells having a layer of heat insulating material within the spaced inner and outer shells. A ceramic insulating material is disposed between the outer and inner shells adjacent the exhaust port outlet to form an exhaust gasket for the exhaust port liner assembly. A method of forming the improved liner is also provided.

The invention provides a method of forming a cylinder head having at least one exhaust port and at least one exhaust valve seat and an exhaust port liner assembly. The exhaust port liner is fabricated by providing a tubular exhaust port liner composed of spaced inner and outer tubular metal shells having a layer of heat insulating material within the space between the inner and outer shells. A removable guard element is disposed between the said inner and outer shells adjacent the exhaust port outlet to prevent molten metal from entering the space holding the insulating material during casting of the cylinder head. The guard element, when removed, forms an annular space for reception of a gasket. While the removable guard is in place between the inner and outer shells, a cylinder head is cast around the port liner assembly with the insulating material between the shells. The removable guard element can be in the form of a discrete rigid collar formed of a material such as a metal capable of withstanding the casting heat or it can be formed by packing foundry core sand into the space between the shells. After casting of the cylinder head, the guard element is removed from between the inner and outer shells and replaced with a ceramic insulating material to form an exhaust gasket between the exhaust port liner assembly and the exhaust manifold.

BRIEF DESCRIPTION OF THE DRAWINGS

The above and other objects and advantages of this invention will be apparent from the following description with reference to the drawings wherein.

Figure 1:
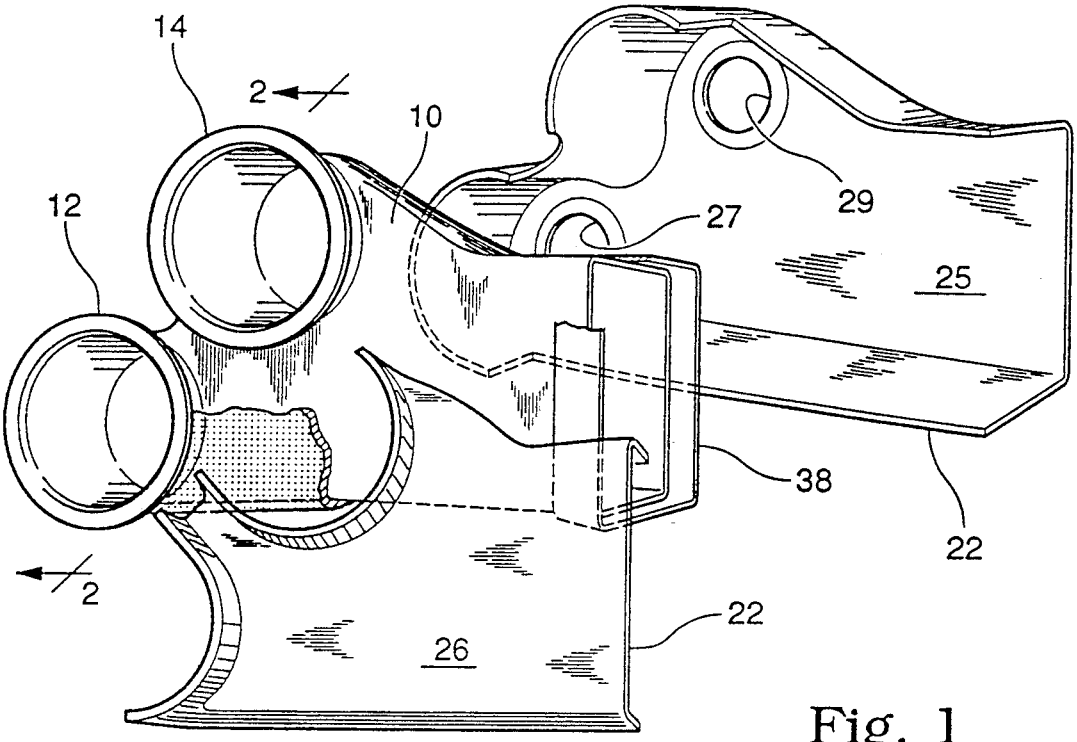
FIG. 1 is a schematic view showing the various parts of the unassembled insulated exhaust port liner of the invention.
Figure 2:
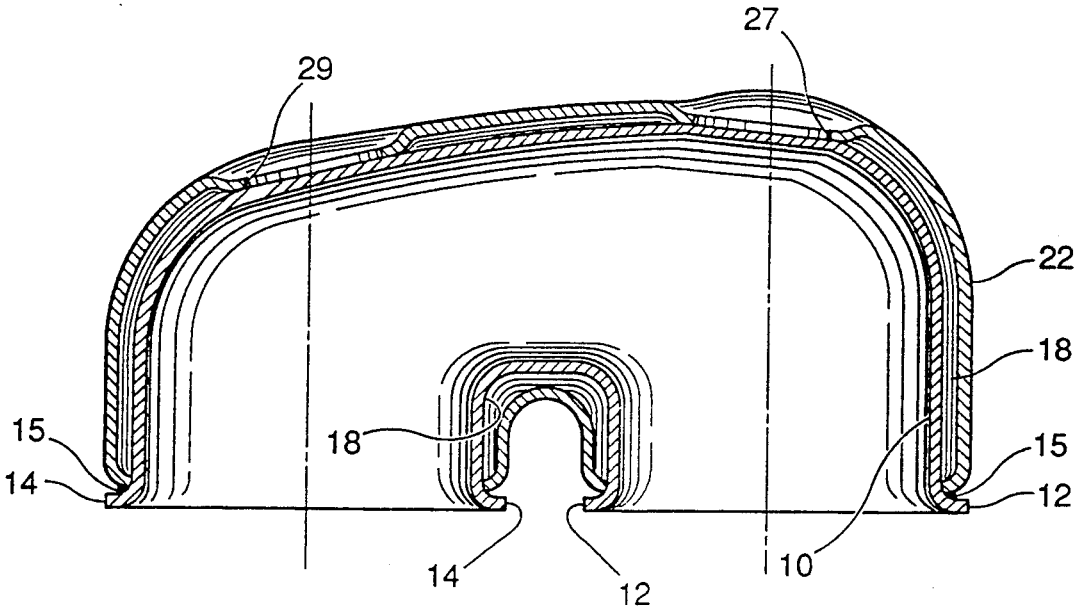
FIG. 2 is a sectional view of the assembled insulated exhaust port liner taken on the line 2—2 of FIG. 1.
Figure 3:
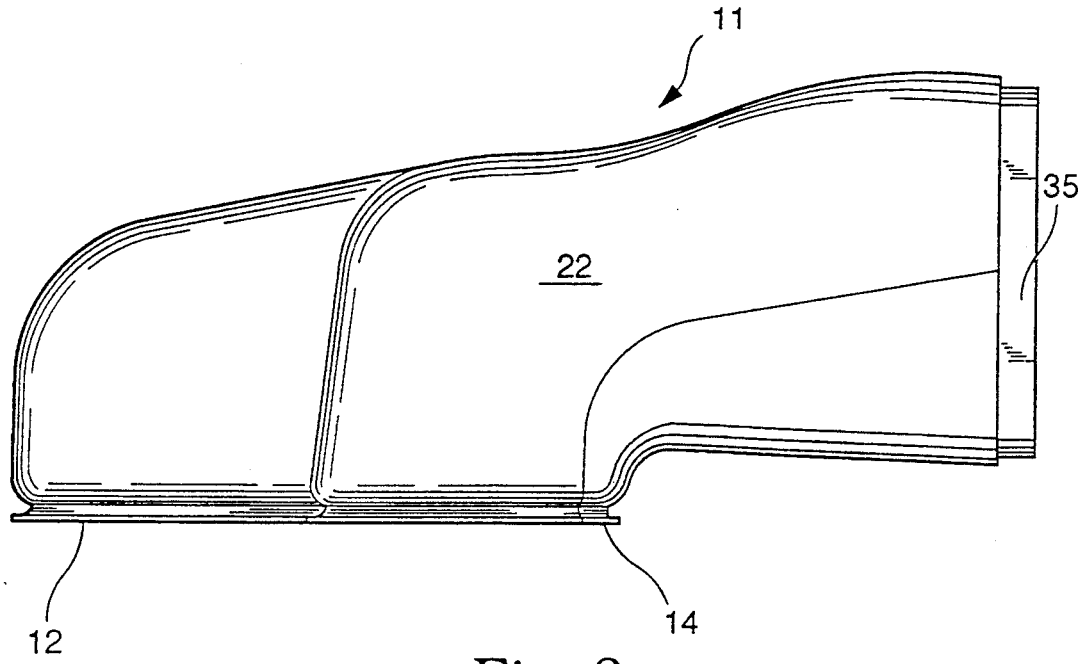
FIG. 3 is a side view of the assembled insulated exhaust port liner of the invention without the removable guard collar which is placed between the shells of the liner prior to casting the cylinder head.
Figure 4:
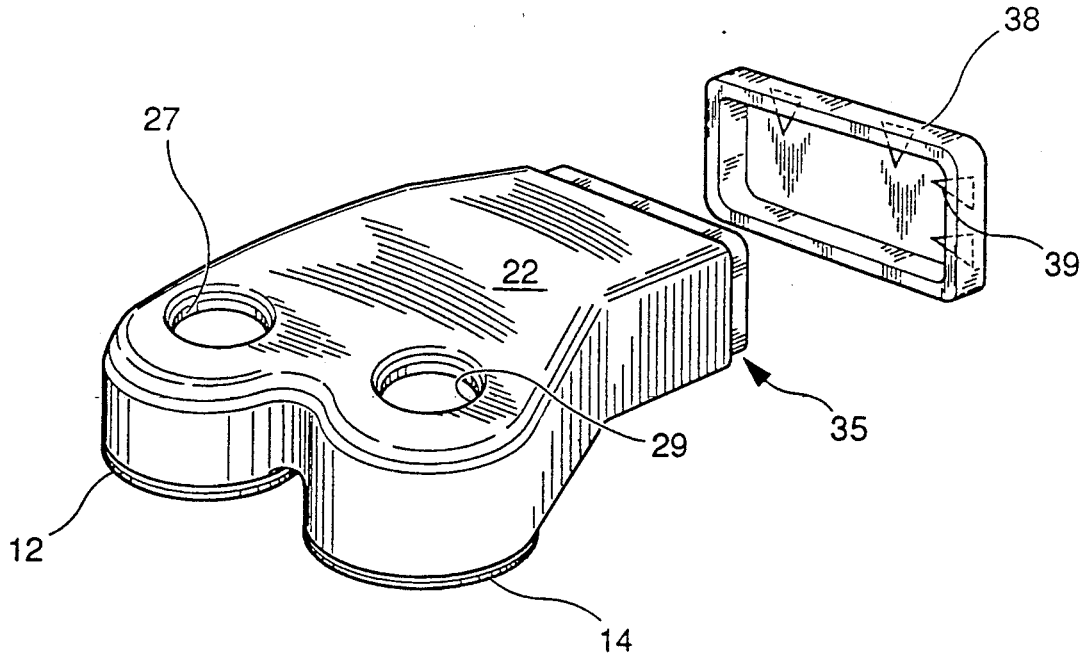
FIG. 4 is a perspective view of the assembled insulated exhaust port liner of the invention and showing one form of a removable guard element which is placed thereon prior to casting the cylinder head.

In one novel aspect, the invention relates to an insulated exhaust port liner which withstands the thermal shock of the cylinder head casting process and eliminates the need for use in the casting process of sand cores in the shape of the port liner. The new liner comprises an inner metal shell which, for illustrative purposes only, is shown as being formed with two valve seat flanges. An insulation material is provided around the inner shell. An outer shell generally similar in shape is spaced from but joined to the inner shell at the valve opening (or inlet port) end of the liner to enclose the insulation. A space is provided between the inner and outer shell members adjacent the port outlet in which there is disposed a ceramic insulating gasket. This design allows expansion of the exhaust port liner to reduce thermal cycling fatigue, and reduces engine cooling requirements by protecting the cylinder head from high heat flux. High heat flux can decrease engine efficiency by heating intake air prior to the compression stroke of the engine and by requiring a larger engine cooling system to remove the greater heat flux.

One embodiment of the present invention involves a method of producing a cylinder head having at least one exhaust port and at least one exhaust valve seat and an exhaust port liner. The method comprises providing a tubular exhaust port liner composed of spaced inner and outer tubular metal shells having a layer of heat insulating material between the spaced inner and outer shells. The inner and outer shells are secured together at the inlet port end by welding or the like. The spacing between the inner and outer shells is preferably on the order of 0.060 to 0.120 inch. A neck space is provided between the inner and outer shells adjacent the exhaust port outlet. A removable guard element is placed in the neck space between the said inner and outer shells adjacent the exhaust port outlet during casting of the cylinder head around the liner. The removable guard is of a size and shape to close the neck space between the inner and outer shells. The guard is maintained in place while performing predetermined treatments on said cylinder head, including the casting of the cylinder head. Then, after casting of the cylinder head and after machining of the workpiece, the guard is removed from between the inner and outer shells and is replaced with a ceramic insulating material to form an exhaust gasket when an exhaust manifold is attached. After casting of the cylinder head around the exhaust port liner, the workpiece can be machined as is necessary or desired.

Referring to the drawings, an inner shell 10 is formed, such as by butt-welding together two complementary shaped halves. The inner shell 10 is formed of a material capable of withstanding, without melting or deforming, high exhaust temperatures on the order of 1500° F. and above and which is also capable of metallurgical bonding with the cast cylinder head. Materials suitable for forming the inner shell 10 are known in the art and illustrative examples of which are INCO 625, Hs 188, Ha 230, 304 Stainless, 312 Stainless and other weldable nickel-based alloys and the like. The inner shell 10 is provided with valve seat flanges 12 and 14, the illustrated liner being adapted to exhaust gas from two valves in a single cylinder of an internal combustion engine. The use of exhaust port liners in accordance with the invention is not limited to exhaustion of gas from two valves however.

A conventional exhaust port liner insulating material 18, such as a ceramic fiber cloth, Nextel, $SiO_2$, $Al_2O_3$ fiber, aluminum silicate and the like, is then placed around inner shell 10. It is appreciated that the air space between the inner and outer shells provides some insulating effect even if no additional insulating material is present. Preferably the insulating material 18 is used in the form of a compliant mass, such as a woven mat, as opposed to a monolithic structure and is of sufficient thickness to substantially completely fill the space between the shells. Most preferably, the insulating material is employed in the form of a woven mat tailored and sewn so as to fit snugly around the inner shell so as to prevent excessive displacement, settling, sagging, compaction or collapse of the insulation over the life of the engine use.

An outer shell 22 comprised of two halves 25 and 26 butt-welded together and shaped similarly to the inner shell 10 but without the valve seat flanges, is welded to the inner shell 10 along weld line 15 adjacent the flanges 12 and 14. The outer shell 22 can be formed of the same material as inner shell 10, but in any event is formed of a material having the properties required for the inner shell 10. The insulating material 18 is then confined between the shells 10 and 22. The top half 25 of outer shell 22 is formed with valve guide holes 27 and 29 which preferably are drilled therein after casting of the head is complete.

In one preferred embodiment as illustrated in the drawings, the inner shell 10 extends outwardly beyond the end of the outer shell at the outlet exhaust port to form a projecting neck portion 35. The neck portion projects outwardly beyond the end of the outer shell approximately 0.20–0.30 inch. This projecting neck portion is desirable to provide stock for final flange machining.

Before casting of the cylinder head, a removable guard element 38 is placed around the projecting neck 35 of the inner shell 10. The guard 38 is of a size and shape to slidably fit on neck 35 and is of a thickness to close the space or gap between the inner shell 10 and outer shell 22. The guard 38 is shown in the drawings as a discrete rigid element and is formed of a material which is capable of withstanding the casting heat without melting and which is capable of maintaining the inner and outer shells in spaced relationship during the casting of the cylinder head. For ease of machining, the rigid removable guard 38 is preferably formed of a metal such as mild carbon steel or stainless steel or ceramic or a carbon/graphite composition. The rigid guard 38 can be provided with a plurality of saw-tooth cut-outs 39 to facilitate its removal after casting. The cut-outs 39 should be located on the inner edge of the guard 38 which extends within the outer shell 22 so as to prevent the incursion of molten metal into the space between the shells. In lieu of a rigid discrete element, guard 38 can be formed of core sand which, after serving its intended purpose, can be loosened and removed.

A cast iron cylinder head designated by the numeral 32 is cast around the assembled port liner 11 consisting of the inner shell 10 and outer shell 22, with the insulating material 18 disposed therebetween. The removable guard 38 prevents molten metal from entering the area occupied by insulating material 18.

Figure 5:
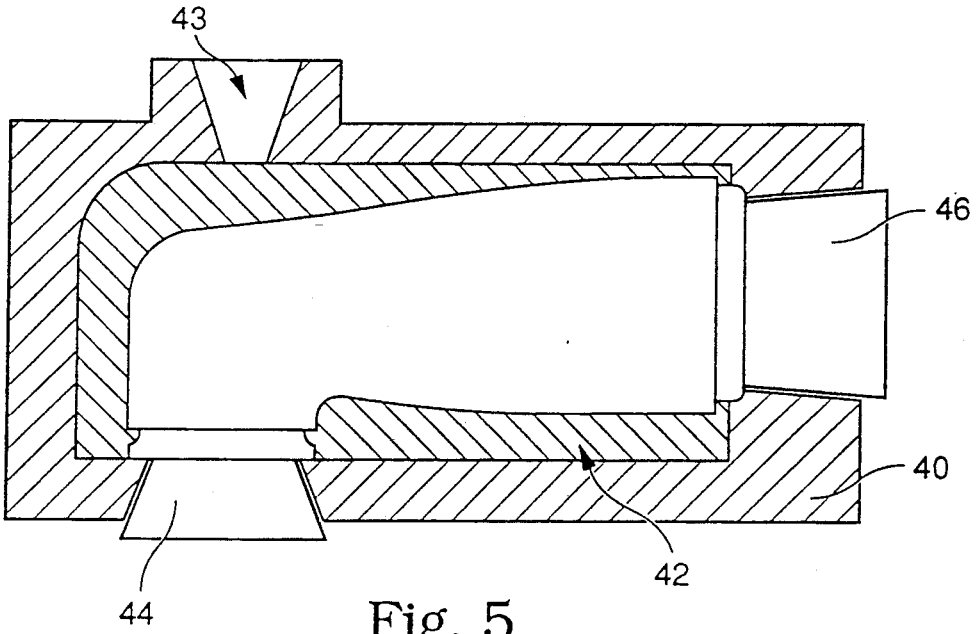
FIG. 5 is a sectional view of the exhaust port liner of the invention disposed within a mold prior to casting a metal cylinder head therearound.

For casting of the cylinder head, the port liner 11 is placed in a suitable mold 40 (FIG. 5) having a suitable void space 42 into which the molten metal is cast, such as through port 43. The mold is suitably shaped so as to form the cylinder head in desired size and shape. Shaped sand cores are thus not required for the casting. Retaining means such as locating pins 44 and 46 hold the port liner 11 in proper position in the mold during the metal casting operation. During casting the outer shell 22 bonds metallurgically to the cylinder head casting 32 over substantially its entire surface and the inner shell 10 bonds metallurgically to the cylinder head casting in the area of flanges 12 and 14, and around the valve guide openings 27 and 29.

Figure 6:
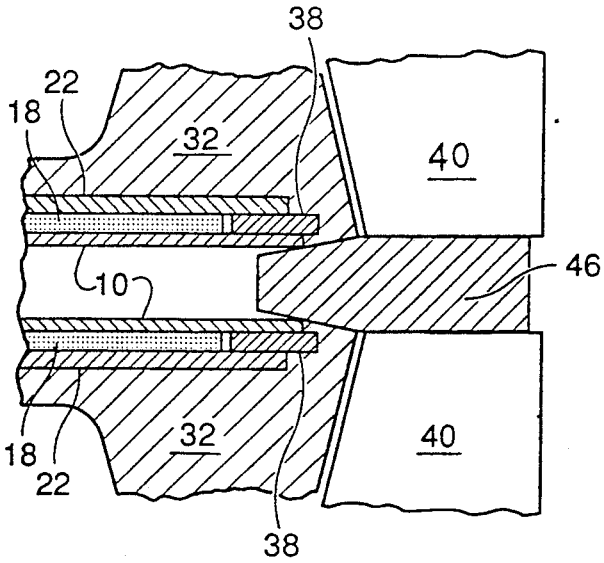
FIG. 6 is an enlarged partial sectional view of the exhaust port liner after casting of a cylinder head therearound and showing one form of a removable guard element between the outer and inner shell components of the liner at the port outlet.
Figure 7:
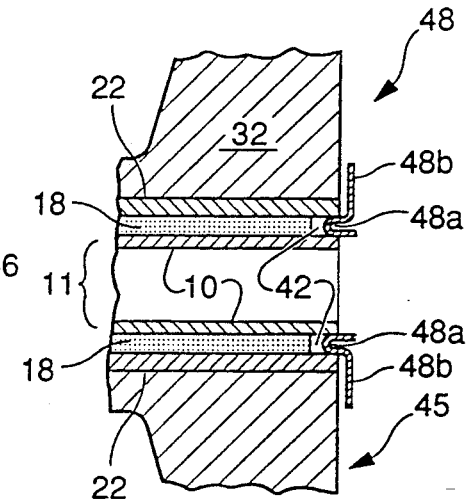
FIG. 7 is an enlarged partial sectional view after machining of the casting and showing an exhaust gas port gasket before insertion thereof into the liner.

FIG. 6 shows a part of the exhaust port liner and the components thereof after casting of the cylinder head 32 therearound and before removal of the casting from mold 40. As will be seen, locating pin 46 maintains the liner in position during the casting process and removable guard 38 prevents molten metal from entering the space between the shells in which insulating material 18 is dispersed.

After casting of the cylinder head 32 around liner 11, the casting is removed from the mold 40 and the locating pins 44 and 46 removed from the liner. The casting is then machined to form a planar casting surface 45 which is later attached to the exhaust manifold of a vehicle. During machining of the casting, the removable guard 38 supports neck portion 35 of the inner shell 10 and reduces the possibility of damaging neck 35 during the machining of the casting.

After machining of the casting, the removable guard or core sand 38 is removed. The guard 38 is of a size to provide an annular space 42 between the inner and outer shells of the liner adjacent to the outlet port. The space 42 serves as a recess for a gasket. A gasket 48, preferably ceramic, is inserted within the space 42 to an inward depth on the order of say 0.30 inch. The gasket can be in an annular form having a head portion 48*a* which extends with the space 42 and a flat flange portion 48*b* which abuts against the flat surface of the machined cylinder head. The gasket 48 serves to prevent gas leakage when the liner assembly is attached to an engine exhaust manifold. This construction allows unrestrained expansion of the exhaust port liner to reduce thermal cycling fatigue and reduces engine cooling requirements by protecting the cylinder head from high exhaust gas temperatures.

Those modifications and equivalents which fall within the spirit of the invention are to be considered a part thereof.

What is claimed is:

1. An exhaust port liner assembly for a cylinder head having at least one exhaust port and at least one exhaust valve seat comprising:

a tubular exhaust port liner composed of spaced inner and outer tubular metal shells having a mass of heat insulating material within the spaced inner and outer shells, said inner and outer shells being secured together adjacent the inlet port end thereof and having a space therebetween adjacent the outlet port end thereof, and a gasket disposed within said space between the inner and outer shells adjacent the outlet port.

2. An exhaust port liner assembly in accordance with claim 1, wherein the mass of insulating material within the spaced inner and outer shells is a compliant mass of an insulating material.

3. An exhaust port liner assembly in accordance with claim 1, wherein the mass of insulating material is in the form of a woven mat which fits snugly over said inner shell.

4. An exhaust port liner assembly in accordance with claim 1 wherein the said gasket is a ceramic gasket.

* * * * *